United States Patent [19]

Cerone

[11] 4,418,792

[45] Dec. 6, 1983

[54] POOL LADDER

[76] Inventor: Daniel J. Cerone, 17 Bluebird Ct., Waterford, N.Y. 12188

[21] Appl. No.: 354,178

[22] Filed: Mar. 3, 1982

[51] Int. Cl.[3] ..... E06C 9/00

[52] U.S. Cl. ..... 182/93; 182/106

[58] Field of Search ..... 182/93, 106, 129, 138, 182/228; 52/182; 272/70, 70.3, 65

[56] References Cited

U.S. PATENT DOCUMENTS

| | | | |
|---|---|---|---|
| 502,070 | 7/1893 | Fairchild | 182/106 |
| 2,721,345 | 10/1955 | Aken | 182/106 |
| 3,420,558 | 1/1969 | Whitten | 182/93 |
| 3,586,124 | 6/1971 | Kunzweiler | 182/106 |
| 3,908,795 | 9/1975 | Gannon | 182/93 |
| 3,973,646 | 8/1976 | Martinez | 182/106 |

*Primary Examiner*—Reinaldo P. Machado
*Attorney, Agent, or Firm*—Heslin & Watts

[57] ABSTRACT

A pool ladder for use by individuals confined to a wheelchair having a top step which is at a height substantially equal to the height of a wheelchair seat, and a second step which is at a height slightly above the wheelchair foot rests. Both the top step and the second step are moveably connected to the ladder so as to allow them to be moved aside during standard use. A series of support members serve a dual purpose by supporting the steps of the ladder and also providing handgrips for one entering or exiting the pool.

14 Claims, 2 Drawing Figures

POOL LADDER

This invention relates to pool ladders which can be adapted for use by individuals confined to wheelchairs for simplified entrance into or egress from a pool.

BACKGROUND AND SUMMARY OF THE INVENTION

Every year a significant number of people become confined to wheelchairs for a variety of reasons. Generally, the need for a wheelchair stems from either a total or partial loss of use of the lower extremities. Being confined to a wheelchair, however, does not displace the need for exercise, and often proper exercise can have a therapeutic effect on those parts of the body which are disabled.

In response to this need for exercise, doctors often prescribe swimming which is not only an excellent form of exercise but also has a beneficial therapeutic effect. Recognizing this, many hospitals utilize both whirlpools and full size pools in their rehabilitative departments. While these rehabilitative centers generally have elaborate apparatus to aid the individual in and out of the pools, when one seeks to use either his own pool or else a public facility, entering or exiting the pool can be a significant difficulty. An additional problem is often experienced in public facilities since lifeguards are generally not allowed to leave their stands and cannot assist someone in entering or leaving the pool. Also, there is usually a requirement that special apparatuses be removed once they are used so as to avoid other patrons from injuring themselves thereon. Without assistance, the responsibility falls on the wheelchair user not only to move himself into the pool, but to remove any special equipment which is used.

Of those devices which are effective in aiding the wheelchair-bound individual, most are both large and expensive. Similarly, many require an assistant to actually operate the apparatus. Many of these devices, such as slings and the like, are not only unpleasant to use, but also fail to take advantage of the ability of the confined person to do much of the moving himself. Thus, there has been a definite need for a device which is effective in aiding the individual in using available pool facilities while also being unobtrusive and suitable for use by people who are not similarly confined.

Thus, it is a primary object of this invention to provide a pool ladder which is suitable to be used by individuals who are confined to wheelchairs.

It is another object of this invention to provide such an invention which is unobtrusive and perfectly suitable for everyday use by individuals who are not confined to wheelchairs.

Another object of this invention is to provide a pool ladder which is appropriate for both wheelchair and standard use and can be converted from one to the other by the wheelchair occupant.

It is a further object of this invention to provide a pool ladder which takes advantage of the at least partial ability of the wheelchair-bound individual to move himself.

It is yet another object of this invention to provide a pool ladder of the type described which is relatively inexpensive.

It is still a further object of this invention to provide a pool ladder which can be used by most wheelchair-bound individuals without assistance.

While these are some of the main objects of the present invention, other objects and purposes will be evident to those skilled in the field when reading the following detailed description.

Briefly described, the present invention consists of a pool ladder for use by individuals who are confined to wheelchairs. The first two steps of the ladder rise above the pool deck and are both moveably connected to the siderails of the ladder. The first step is at a height substantially equal to the height of a standard wheelchair seat and the second step is slightly higher than the wheelchair footrests. All of the steps rest upon supports which extend between portions of each siderail and serve both as supports for the steps and as handgrips to aid one in lowering himself from one step to the next.

DETAILED DESCRIPTION OF THE DRAWINGS

Figure 1:
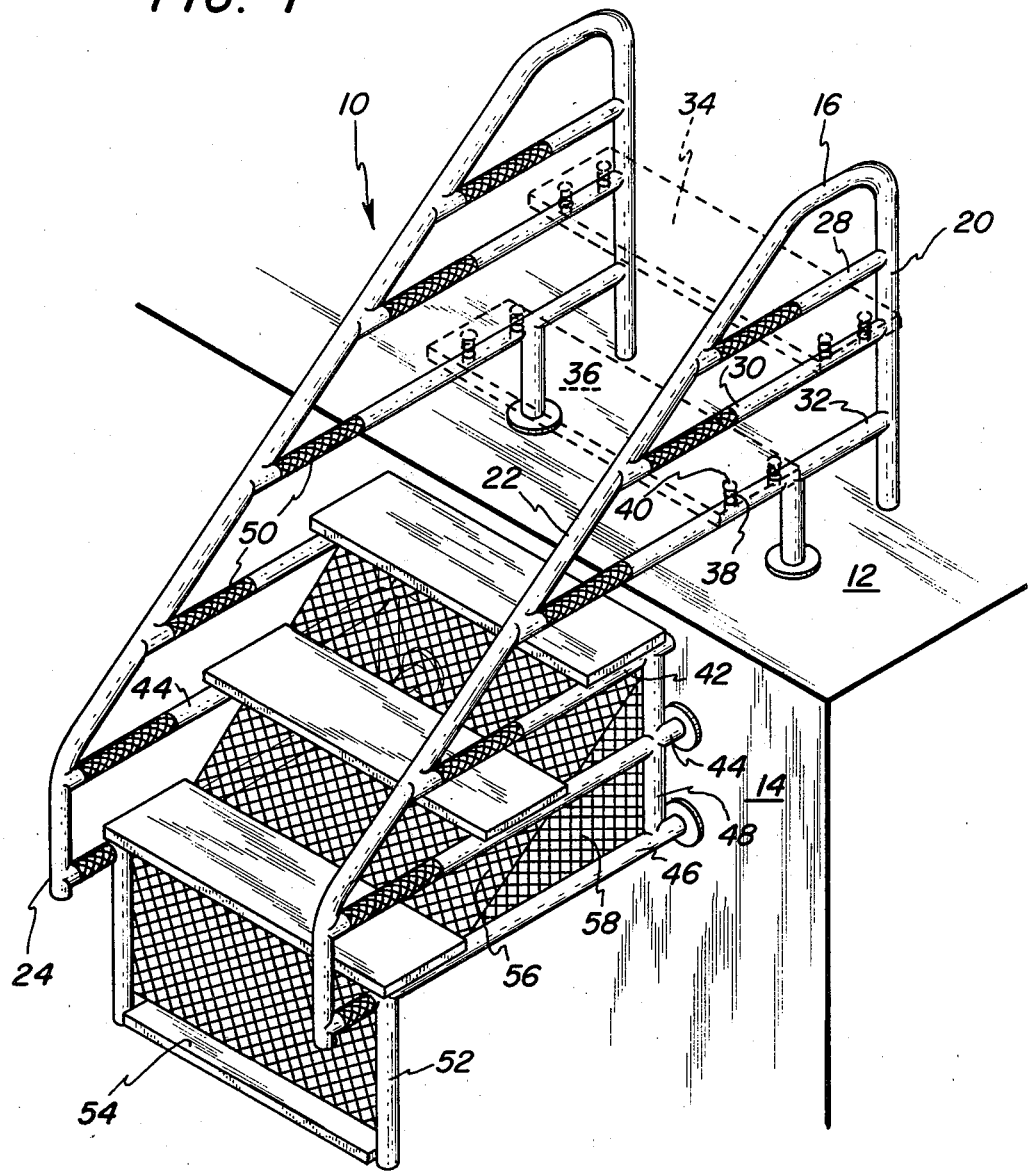
FIG. 1 is a front perspective view of the invention with all the steps in place.

FIG. 1 shows the entire ladder structure generally designated as 10. Generally, the ladder is secured to a plane surface such as a pool deck 12. The ladder then extends from the deck downwardly into the pool where it rests against the pool wall 14.

The ladder consists of a pair of siderails 16 which are secured to the pool deck in a spaced apart relationship sufficient to allow a wheelchair to be moved therebetween. A series of steps are connected to the siderails and span the distance between them.

The siderails, more specifically described, each have a vertical portion 20 which is secured to the deck and rises perpendicularly thereto. At the top of the vertical portion, the siderails are rounded so as to bend both in a downward and outward direction toward the pool. Thus, the next segment of the siderail is a descending portion 22 which slopes downwardly into the pool. At the end of the descending portion, the siderails turn straight downward forming a second vertical portion 24 which is approximately 10 inches long.

Each siderail has a series of support members 28, 30, 32, 42, 44 and 46. The first three support members are above the deck area and the last three are below the deck area. Although there are two siderails and support member assemblies, only one will be described in detail since they are identical. The three support members 28, 30 and 32, which are above the deck, are secured at one end to the vertical portion 20 of siderails 16 and at the other end to the descending portion 22. These support members are placed in a spaced apart relationship and I have found the following dimensions to be most suitable. The distance between the top of the vertical portion 20 to the first support member 28 is $6\frac{1}{2}$ inches, between the first and second support member 30 is a distance of $4\frac{1}{2}$ inches, and between the second and third support member 32 is, once again, $6\frac{1}{2}$ inches.

In FIG. 1, the top step 34 and the second step 36 are shown in phantom to illustrate the fact that they are moveably secured to support members 30 and 32, respectively. One simple way in which to secure the steps in a moveable manner is by drilling receiver holes 38 in the support members and then simply installing pegs 40 in the underside of the steps. Of course, a variety of other methods, such as hinges or the like, could be used to provide this moveable feature.

Figure 2:
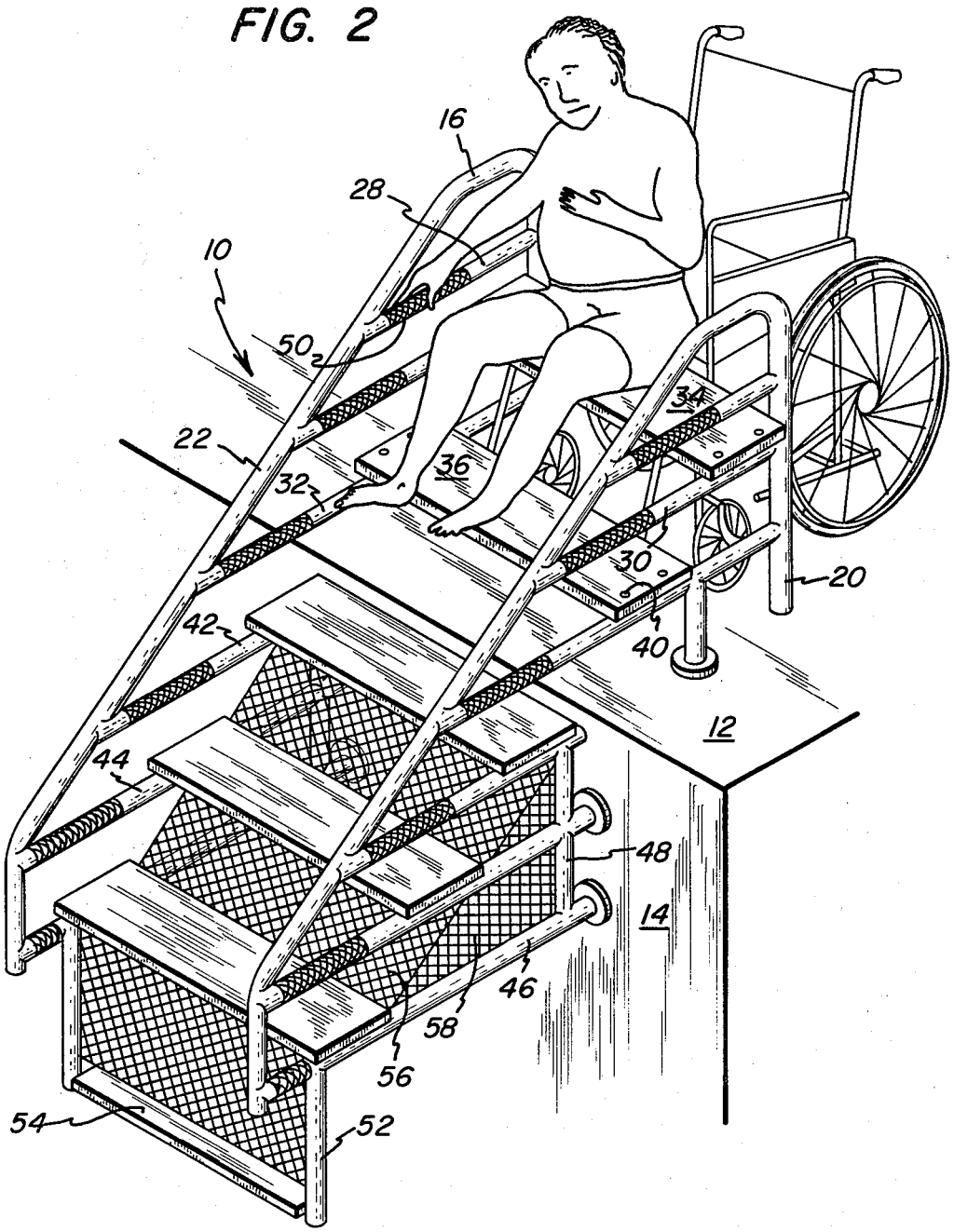
FIG. 2 is a front perspective view of the invention in use.

To facilitate movement from the wheelchair to the top step, the height of the top step is approximately equal to the height of the wheelchair seat (See FIG. 2). In most cases, the wheelchair seat is between 17 and 19 inches above the plane and, therefore, I have found it preferable to have the top step at a height of 14 to 18 inches above the plane. Similarly, most wheelchair footrests are at least four inches above the plane upon which the wheelchair rides. In order to allow for the movement of these rests under the second step, my preferred embodiment of this invention has the second step more than four inches above the plane. Both the top and second step are positioned over the deck in order to allow the individual to completely situate himself upon the ladder before proceeding out over the water.

As previously mentioned, there are also three support members which are below the plane of the deck. The last of these is the sixth support member 46 which is connected on one end to the lowest part of the second vertical portion 24 and at the other end it rests against the side of the pool. At a height of about 6½ inches above the sixth support member is the fifth support member 44 which is also attached to the second vertical portion 24 of siderail 16 on one end and rests against the pool wall on the other. Six and one-half inches above the fifth support is the fourth support member 42, which is connected on one end to the descending portion 22 and on the other end stops just short of the pool wall. A support bar 48 connects this free end of the fourth support member to the fifth and sixth support members which lie under it.

The third through fifth steps are secured in a substantially permanent fashion to the fourth, fifth and sixth support members, respectively. One way in which I have accomplished this is by fastening the steps to the support members with angle irons (not shown); however, numerous other methods, such as bolting or the like, are equally feasible. All of the steps when viewed together form a flight of steps running downwardly into the pool.

While each support member is partially covered by a step, there is a section in the forwardmost part of the support member which is not covered. A non-slip covering is applied to these forwardmost portions so that they can serve as hand grips 50. These grips allow the user to move himself to the next lower step and finally into the water. Similarly, they function to aid the user in raising himself from one step to the next upon returning to the wheelchair.

Extending downwardly from the sixth support member 46 of each siderail at a place directly under the fifth step are rung holders 52. At the lowermost portion of the rung holders, a rung 54 is secured so as to span the gap between the siderails.

In my preferred embodiment, a backing 56 closes off the spaces between the steps so as to prevent anyone from slipping therebetween. Similarly, a protective net 58 extends from the last step back to the pool wall in order to assure that no one will be injured by surfacing beneath the ladder. For both the backing 56 and the net 58, I have found it suitable to use a durathene hardware cloth. However, it will be realized that various types of backing materials such as fiber glass or plastic would be totally suitable. I have also provided the same type of backing between the fifth step and rung 54 so as to prevent slipping through the open space which exits therebetween.

I anticipate that in its most common usage, the top two steps of the ladder will be maintained in their functional position, spanning the siderails. The user will then move his wheelchair up to the ladder and, either alone or with assistance, lift his legs over the top step. The wheelchair is then moved in closer to the ladder and the user's feet are generally placed either on or in front of the second step. It should be noted that the second step 36 is of sufficient height so as to allow the footrests of the wheelchair to move thereunder. The individual then grasps the first support member 28 and slides himself onto the top step 34. At this point, the individual can position himself for the next move. When ready, he will then grab the second support member 30 at the hand grip portion 50 and lower himself onto the second step 36. This procedure is completed until the person has completely entered the pool. When exiting, this procedure is simply reversed.

In another mode of operation, the top two steps are removed and the wheelchair and occupant are moved between the siderails 16. Once in place, top step 34 is put back into position, but this time it is inserted under the thighs of the individual. Similarly, second step 36 is also replaced and the individual's feet can either be placed thereon or the second step can be put behind the individual's ankles.

This invention can be fashioned so that when the special features are not needed, the top step and second step can either be removed or simply moved aside. Without these two steps spanning the distance between the siderails, the ladder is totally suitable for standard usage. It will be appreciated that one using the invention could himself install or remove the first two steps without undue difficulty.

Changes and modifications in the specifically described modifications can be carried out without departing from the scope of the invention which is intended to be limited only by the scope of the appended claims.

What is claimed:

1. A pool ladder to facilitate the downward movement of an individual from a wheelchair which is positioned on a plane surface, such as a pool deck, into a pool comprising:

means for supporting a plurality of steps in the form of a flight of stairs running downwardly from a top step into the pool, the top step being at a position accessible from a wheelchair on the deck;

a top step connected to the support means, said top step positioned to be accessible from a wheelchair on the deck and at a height above the deck approximately equal to the height of a wheelchair seat; and a plurality of steps which, together with the top step, form a flight of stairs running downwardly into the pool.

2. The invention of claim 1 wherein the supporting means further comprises at least two siderails secured to the plane surface and extending into the pool, said siderails being secured in a spaced apart relationship so as to allow for the movement of the wheelchair therebetween, and wherein the top step and the plurality of steps forming the flight of stairs are connected to the siderails so as to span the space therebetween.

3. The invention of claim 2 wherein the top step is moveably connected to the siderails such that it can be moved aside so as to no longer span the space between the siderails.

4. The invention of claims 1, 2 or 3 wherein a second step next follows the top step, said second step being at a height above the plane so as to allow for the movement of the wheelchair's footrests thereunder.

5. The invention of claim 4 wherein the second step is moveable connected to the siderails such that it can be moved aside so as to no longer span the space between the siderails.

6. The invention of claim 5 wherein the top step is between 14 to 18 inches above the plane.

7. The invention of claim 5 wherein the second step is at least four inches above the plane.

8. The invention of claim 1, 2 or 3 wherein the siderails further comprise:

a vertical portion which is secured to the plane and rises substantially perpendicular thereto; and a descending portion which slopes in a downward and outward direction from the uppermost part of the vertical portion into the pool.

9. The invention of claim 8 wherein the siderails further comprise:

a first series of support members each of which is attached to the vertical portion and extends substantially perpendicular thereto until they reach the descending portion of the siderail to which they are also connected.

10. The invention of claim 9 wherein the steps are connected to the support members.

11. The invention of claim 10 wherein a portion of each support member is not covered by its associated step so that said uncovered portion can serve as a hand grip which enables the user to lower himself to the next succeeding step.

12. The invention of claim 11 wherein said hand grip portion is covered by a non-slip material.

13. The invention of claim 12 further comprising:

a backing means to close the space between the steps so as to prevent a user's body from entering therebetween; and means for blocking the underside of the ladder so that swimmers will be prevented from surfacing from beneath the steps.

14. The invention of claim 13 wherein a rung is suspended from the siderails and spans the distance between the siderails, said rung being positioned directly below the last step within the pool.

* * * * *